United States Patent [19]

Barkley et al.

[11] Patent Number: 4,808,997

[45] Date of Patent: Feb. 28, 1989

[54] PHOTOELECTRIC VEHICLE POSITION INDICATING DEVICE FOR USE IN PARKING AND OTHERWISE POSITIONING VEHICLES

[76] Inventors: George J. Barkley; Roberta Barkley, both of 283 Wooded La., North Barrington, Ill. 60010

[21] Appl. No.: 53,151

[22] Filed: May 21, 1987

[51] Int. Cl.[4] ..... G08G 1/04

[52] U.S. Cl. ..... 340/942; 340/51; 340/52 H; 340/988; 340/958; 250/491.1

[58] Field of Search ..... 340/942, 51, 52 H, 56, 340/988, 958, 686; 250/491.1, 222.1, 561; 350/484, 486; 180/168; 356/51, 141, 151-153, 399, 400

[56] References Cited

U.S. PATENT DOCUMENTS

| | | | |
|---|---|---|---|
| 2,366,152 | 12/1944 | Lauterbach . | |
| 2,605,393 | 7/1952 | Holm . | |
| 2,896,089 | 7/1959 | Wesch . | |
| 3,110,008 | 11/1963 | Kendall et al. . | |
| 3,360,775 | 12/1967 | Schroeder . | |
| 3,416,129 | 12/1968 | Dean . | |
| 3,436,540 | 4/1969 | Lamorlette | 340/942 |
| 3,491,334 | 1/1970 | Martin . | |
| 3,514,610 | 5/1970 | Huston et al. . | |
| 3,732,555 | 5/1973 | Strenglein . | |
| 3,749,918 | 7/1973 | Jones . | |
| 4,278,962 | 7/1981 | Lin . | |
| 4,284,971 | 8/1981 | Lowry et al. . | |
| 4,407,388 | 10/1983 | Steel . | |
| 4,467,313 | 8/1984 | Yoshino et al. . | |

FOREIGN PATENT DOCUMENTS 05138 8/1987 World Int. Prop. O. ..... 340/942

OTHER PUBLICATIONS

Leaflet entitled Warner Photoscanner, MCS-165 & MCS-165 V, Installation and Operating Instructions, Photoelectric Controls, Warner Electric Brake & Clutch Company, Motion Control Systems Division, 1300 North State Street, Marengo, Illinois 60152 (Dated 12/83).

Leaflet entitled Warner MCS-830/830-1/830-2, Installation and Operating Instructions, MCS-830 Series Multifunction Plug-in Timer Modules for MCS-165 Series Photoelectric Controls, Warner Electric Brake & Clutch Company, 1300 North State Street, Marengo, Illinois 60152, (Dated 5/82).

Catalogue pp. G-10, G-11, G-12 and G-13 of Warner Electric Brake & Clutch Company, South Beloit, Illinois, entitled Reflective/Proximity Scanners.

Catalogue pp. 24 and 25 of Micro Switch, a Honeywell division, entitled MLS9B Self-contained diffuse scan controls.

*Primary Examiner*—Donnie L. Crosland

*Attorney, Agent, or Firm*—Burmeister, York, Palmatier, Hamby & Jones

[57] ABSTRACT

The position indicating device is employed to assist in parking and otherwise positioning a vehicle on a supporting surface. A photoelectric control unit is mounted on an overhead structure spaced above the supporting surface and has a beam emitting device for directing a light beam downwardly for interception by the vehicle, while minimizing the likelihood of interception by pedestrians, pet animals and other moving things. The light beam is initially reflected back to a photoelectric transducer on the control unit by a reflective device or mirror. The light beam is pulsed so that the transducer supplies electrical pulses to an amplifier which is correspondingly gated. When the light beam is interrupted by the vehicle, the amplifier produces a beam interruption output signal which causes a one-shot timer to energize an alarm device, through an output relay. The operator then stops the vehicle in the desired position. The one-shot timer de-energizes the alarm device after a brief interval. Alternatively, the mirror is not employed, and the light beam is not significantly reflected back to the transducer until the light beam is intercepted by the vehicle, whereupon reflection from the vehicle produces a reflected light beam to the transducer. The corresponding pulsed signals from the transducer operate the amplifier, which is modified so that it actuates the timer, whereby it energizes the alarm device for a timed interval.

11 Claims, 3 Drawing Sheets

PHOTOELECTRIC VEHICLE POSITION INDICATING DEVICE FOR USE IN PARKING AND OTHERWISE POSITIONING VEHICLES

FIELD OF THE INVENTION

This invention relates to a photoelectric device for indicating the position of a vehicle, for assistance in precisely parking or otherwise positioning vehicles, such as automobiles, roadway trucks, industrial trucks and other industrial vehicles.

BACKGROUND OF THE INVENTION

It is often a problem to park or otherwise position a vehicle with a high degree of precision in a limited space, so that the vehicle is closely spaced from a wall or other obstacle, yet does not come into contact with the obstacle. For example, in parking an automobile in a garage having a limited parking space, only a little longer than the automobile, it is necessary to position the automobile with its front end close to the rear wall of the garage, while avoiding any contact between the automobile and the rear wall, because such contact could damage the rear wall.

Similarly, in backing a roadway truck into a parking stall at a loading dock, it is desirable to position the truck close to the loading dock, while avoiding any actual contact with the dock.

Industrial trucks, such as fork lift trucks, are often used to place palletized loads close to a wall or other obstacle, while avoiding any contact with the wall.

The present invention is directed to the problem of making it easy to park or otherwise position a vehicle with a high degree of precision, in a limited space, bounded by a wall or other obstacle, by driving the vehicle to a predetermined position, close to the obstacle, while avoiding any contact with the obstacle.

Thus, one principal object of the present invention is to provide a new and improved device which operates an alarm when the vehicle is maneuvered to the predetermined position, close to the wall or other obstacle, so that the operator of the vehicle may stop the vehicle, without causing it to come into contact with the obstacle.

Another object is to provide such a new and improved device which is reliable, easy to install and inexpensive.

SUMMARY OF THE INVENTION

In accordance with the present invention, these and other objects are achieved by providing a vehicle position indicating device for assisting in parking and otherwise positioning a vehicle in a predetermined space on a supporting surface, such device comprising photoelectric control means having mounting means for mounting such photoelectric control means adjacent such space in a location affording clearance for the vehicle, such photoelectric control means including light emitting means for emitting and directing a beam of identifiable light in a predetermined direction along a beam path forming a boundary for such space, such photoelectric control means comprising photoelectric transducer means adjacent such light emitting means and directed generally in such predetermined direction for receiving reflected identifiable light constituting a reflection of such beam and for producing reflection related electrical signals corresponding to such reflected identifiable light, such reflected identifiable light constituting at least a partial continuation of such beam, the vehicle being movable along such supporting surface for intercepting the beam and thereby causing a change in such reflected identifiable light reaching such transducer means whereby such transducer means produces a corresponding change in the reflection related electrical signals, amplifer means for receiving such reflection related electrical signals and producing an output signal in response to such change in the reflection related electrical signals, one-shot timing means for receiving each output signal and producing a corresponding one-shot energization signal having a predetermined time duration, alarm means for producing a sensory alarm, and relay means for receiving each one-shot energization signal and correspondingly energizing the alarm means for a time interval corresponding to the time duration of the one-shot energization signal.

This invention contemplates broadly that the predetermined direction of the light beam may be in any desired or suitable direction, which may be horizontal, vertical or at any intermediate angle. The beam may be directed downwardly, upwardly, horizontally, or at any desired or suitable inclined angle.

In accordance with one aspect of the present invention, the vehicle position indicating device may include reflective means for receiving such beam and producing such reflection of such beam back to such photoelectric transducer means, such reflection containing a large quantity of such reflected identifiable light, the movement of the vehicle being effective to cause interruption of such reflection whereby the change in the reflected identifiable light constitutes a substantial decrease therein, the corresponding change in the reflection related electrical signals produced by the photoelectric transducer means being a corresponding decrease in such reflection related electrical signals, the amplifier means having means for producing such output signal in response to such decrease in the reflection related electrical signals whereby the alarm means is operative to produce the sensory alarm for such time interval.

The reflective means may advantageously take the form of a retroreflective mirror or reflector, which may have retroreflective cube corner elements, for reversing the direction of the beam and reflecting it back toward the source from which it came.

Another alternative aspect of the present invention does not employ any separate mirror, reflector or other reflective means. Instead, the vehicle is movable along such supporting surface for intercepting the beam and producing an increase in such reflected identifiable light due to reflection of the beam by the vehicle, such transducer means producing a corresponding increase in the reflection related electrical signals, such amplifier means having means for producing an output signal in response to such increase in the reflection related electrical signals, whereby the alarm means produces the sensory alarm for such time interval.

In accordance with either aspect of the present invention, the photoelectric control means may comprise pulsing means for pulsing such light emitting means and for correspondingly pulsing such amplifier means. The pulsing action makes the light identifiable, whereby the amplifier means is fully responsive to the pulsed reflection related signals, produced by the transducer means, while being substantially unresponsive to ambient light.

The alarm means may include a sound emitting device, for producing an audible alarm, an alarm lamp for producing a visible alarm, or both a sound emitting device and an alarm lamp.

In a more specific aspect of the present invention, there is a definite advantage in utilizing an overhead structure spaced upwardly from such supporting surface and affording clearance for the vehicle, the position indicating device comprising photoelectric control means having mounting means for mounting such photoelectric control means on the overhead structure, such photoelectric control means including light emitting means for emitting and directing the beam of identifiable light in a generally downward direction toward the supporting surface and along a beam path forming a boundary of such space, such photoelectric control means comprising photoelectric transducer means directed in a generally downward direction for receiving upwardly reflected identifiable light constituting a reflection of such beam and for producing reflection related electrical signals corresponding to such reflected identifiable light, such reflected identifiable light constituting at least a partial continuation of such beam, the vehicle being movable along such supporting surface for intercepting the beam and thereby causing a change in such reflected identifiable light reaching such transducer means whereby such transducer means produces a corresponding change in the reflection related electrical signals, the amplifier means, the one-shot timing means, the alarm means and the relay means being constructed and arranged as previously described. The mounting of the photoelectric control means on the overhead structure, and the downward direction of the beam have the advantage of reducing the possibility of extraneous interception or interruption of the beam by the movement of persons, pet animals, or things other than the vehicle.

In one aspect, as before, the vehicle position indicating device may include reflective means, such as a retroreflective mirror, adapted to be supported adjacent the supporting surface for receiving the downwardly directed beam and reflecting such beam in a generally upward direction to produce such reflection containing a large quantity of such reflected identifiable light directed upon such photoelectric transducer means, the movement of the vehicle being effective to cause the vehicle to interrupt such reflection whereby the change in the reflected identifiable light constitutes a substantial decrease therein, the amplifier means having means for producing such output signal in response to the corresponding decrease in the reflection related electrical signals whereby the alarm means is operative to produce the sensory alarm for such time interval.

In an alternative aspect, as before, the movement of the vehicle along such supporting surface is effective to cause the vehicle to intercept and reflect the beam of identifiable light back to the photoelectric transducer means whereby the change in the reflected identifiable light constitutes a substantial increase therein, the amplifier means having means for producing such output signal in response to the corresponding increase in the reflection related electrical signals whereby the alarm means is operative to produce the sensory alarm for such time interval.

The operator of the vehicle drives the vehicle along a path toward the predetermined space or position, until the vehicle intercepts the light beam, whereupon the alarm device is energized, whereupon the operator stops the vehicle in the predetermined space. The alarm device is de-energized automatically by the operation of the one-shot timing means.

The light emitting means may advantageously include a light emitting diode, while the photoelectric transducer means may include a photosensitive transistor. The light emitting means may advantageously produce infrared light, but may alternatively produce visible light.

The relay means may advantageously comprise an electromagnetic switching relay, connected between the one-shot timing means and the alarm means, for energizing the alarm means in response to each one-shot energization signal.

BRIEF DESCRIPTION OF THE DRAWINGS

Further objects, features and advantages of the present invention will appear from the following description, taken with the accompanying drawings, in which.

DETAILED DESCRIPTION OF ILLUSTRATIVE EMBODIMENTS

Different illustrative embodiments of the present invention will be disclosed herein, along with various modified embodiments, all of which may be constructed by persons skilled in the art. The disclosure of various illustrative embodiments and modifications is not intended to limit the scope of the invention. It will be understood that various modifications, alternative constructions and equivalents may be employed, within the scope of the appended claims.

Figure 1:
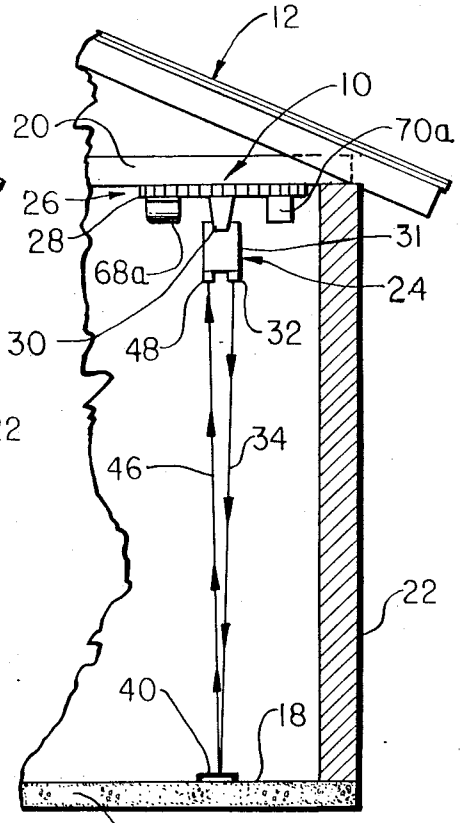
FIG. 1 is a diagrammatic vertical section, showing an illustrative embodiment of the present invention, as installed in a garage for parking an automobile or some other vehicle, such illustrative embodiment being in the form of a photoelectric device for indicating the parked position of the vehicle.
Figure 2:
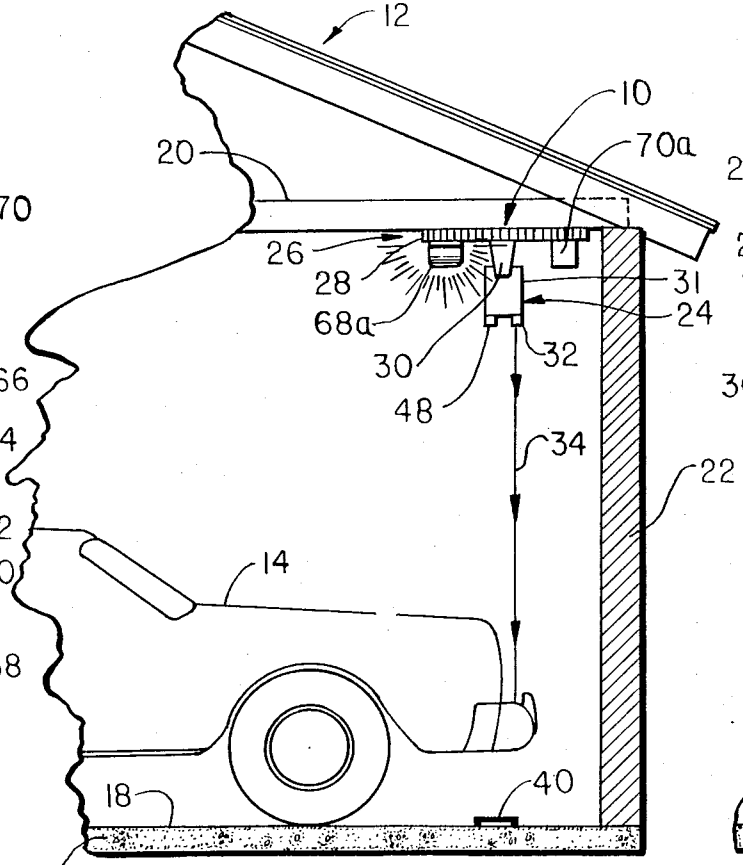
FIG. 2 is a view similar to FIG. 1, but showing the manner in which the vehicle interrupts the light beam of the photoelectric device, whereupon an alarm device is energized.
Figure 3:
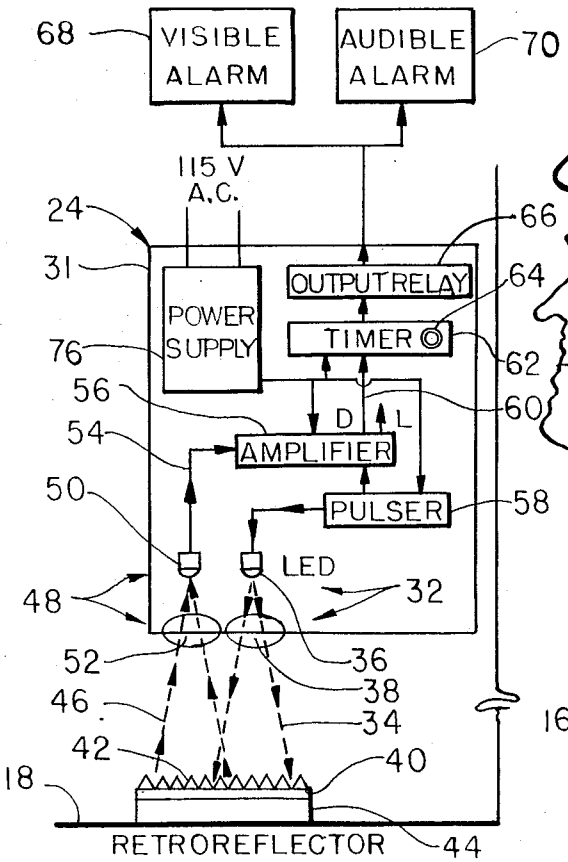
FIG. 3 is a schematic block diagram, illustrating the construction of the photoelectric indicating device of FIGS. 1 and 2.

As just indicated, FIGS. 1–3 illustrate a vehicle position indicating device 10, to be described as an illustrative embodiment of the present invention. As shown in FIGS. 1 and 2, the vehicle positioning device 10 is installed in a garage 12 for use in parking a vehicle, such as the illustrated automobile 14. The garage 12 has a floor 16 which provides a supporting surface 18, on which the vehicle 14 is driven and parked. The garage 12 has an overhead structure 20, spaced upwardly from the supporting surface 18 and affording clearance for the vehicle 14. The garage 12 has a rear wall or other obstacle 22, close to which it is desirable to park the vehicle 14, without bringing the vehicle into contact with the wall or other obstacle 22. Such contact might result in damage to the wall 22 or to the vehicle 14.

The vehicle position indicating device 10 includes photoelectric control means 24 having mounting means 26 for mounting the control means 24 on the overhead structure, such mounting means 26 comprising a mounting base 28, secured to the overhead structure 20, as by means of screws or other fasteners, and an adjustable bracket 30, secured to the mounting base 28 by screws or other fasteners, for adjustably supporting the photoelectric control means 24. The components of the photoelectric control means 24 are mounted on a housing 31 which is adjustably mounted on the bracket 30.

The photoelectric control means or unit 24 comprises a light emitting device 32 for emitting and directing a light beam 34 along a generally vertical beam path which is directed in a generally downward direction, toward the supporting surface 18, as shown in FIGS. 1 and 2. The path of the beam 34 forms a boundary for the space or position to be occupied by the vehicle 14, which is adapted to be driven along the supporting surface 18 until the vehicle intercepts the light beam 34.

There is a definite advantage in providing the mounting means 26 for mounting the control means 24 on the overhead structure 20, with the light beam 34 directed along a beam path which is generally vertical and generally downward, in that the possibility is thereby reduced of extraneous interruption or interception of the light beam by the movement of persons, pet animals, or things other than the vehicle. However, this invention contemplates broadly that the predetermined direction of the light beam may be in any desired or suitable direction, which may be horizontal, vertical or at any intermediate angle. The beam may be directed downwardly, upwardly, horizontally, or at any desired or suitable inclined angle.

As shown in FIG. 3, the light emitting device 32 comprises a light emitting diode (LED) 36, which provides an advantageous light source, although sources of other types may be employed. The light emitting device 32 also comprises a focusing lens 38 which focuses the light from the LED 36 and produces the light beam 34, in which the light rays are generally parallel or only slightly divergent.

The position indicating device 10 of FIGS. 1–3 comprises a reflective device 40, illustrated as taking the form of a retroreflective mirror, preferably having cube corner retroreflective elements 42. In another embodiment, to be described herein, the reflective device is not employed. In the particular construction of FIGS. 1 and 2, however, the retroreflective device or mirror 40 is supported adjacent the supporting surface 18, either directly on the supporting surface 18, as shown in FIG. 1, or on a supporting base or bracket 44, as shown in FIG. 3. Various means may be provided to support the retroreflective mirror 40. By means of the retroreflective mirror 40, the incident light beam 34 is reflected upwardly along a generally vertical beam path, to provide a reflected beam 46.

The photoelectric control means or unit 24 comprises beam receiving means 48 including a photoelectric transducer 50 and a lens 52 for focusing the reflected beam 46 upon the transducer 50, which produces corresponding beam related electrical signals. The photoelectric transducer 50 preferably takes the form of a photosensitive transistor, but photoelectric transducers of other types may be employed.

By means of a signal transmitting connection 54, as shown diagrammatically in FIG. 3, the beam related electrical signals are transmitted from the output of the photoelectric transducer 50 to the input of amplifier means 56, labeled AMPLIFIER in FIG. 3. The amplifier 56 is of the well known, commercially available type having a light output terminal L and a dark output terminal D, as labeled in FIG. 3. The construction of the amplifier 56 is such that it amplifies the beam related input signals, when supplied by the transducer 50, and produces a direct current output at the light output terminal L. When the beam related input signals are not supplied to the amplifier 56, it produces a direct current output signal at the dark output terminal D, while not supplying any output signal to the light output terminal L. When beam related input signals are supplied to the amplifier 56, it does not produce any output signal at the dark output terminal D.

In the photoelectric control unit 24 of FIG. 3, both the light emitting diode 36 and the amplifier 56 are preferably pulsed by pulsing means, labeled PULSER 58 in FIG. 3. Thus, the LED 36 is provided with repetitive energization pulses having high peak power, but low average power, so that the LED 36 produces bright flashes, without being overloaded. In this way, the LED 36 and the lens 38 produce a flashing beam having sufficient range to produce a strong signal at the photoelectric detector or transducer 50. The amplifier 56 is strobed or gated by the pulses from the pulser 58, in synchronism with the pulses of light produced by the LED 36 and the corresponding electrical pulses produced by the photoelectric transducer 50, so that the amplifier 56 responds to such electrical pulses, while being virtually immune to the unpulsed signals produced by ambient light, received by the transducer 50. Thus, the pulsing of the light beam makes it identifiable and distinguishable from other light which may exist in the area.

When the light beam 34 from the LED 36 is reflected by the retroreflective mirror, and the reflected light beam 46 reaches the photoelectric transducer 50, the corresponding beam related signals are supplied to the amplifier 56, which produces an output signal at its light output terminal L, while producing no output signal at the dark output terminal D. When the incident or reflected light beam 34 or 46 is interrupted, the beam related signals to the amplifier 56 are interrupted, whereupon the amplifier 56 switches its output signal from its light output terminal L to its dark output terminal D. As shown in FIG. 3, an output connection 60 is provided between the dark output terminal and the input of timing means 62, labeled TIMER in FIG. 3. Such timer 62 is preferably an electronic module of the well known one-shot type, which produces a single output pulse or signal of a specifically timed duration, in response to each input signal. The timer 62 is illustrated as having an adjusting knob or other control 64, for adjusting the time duration of each one-shot output pulse. For example, the time duration may be adjustable from approximately one to thirty seconds. Typically, the adjusting control 64 is adjusted to provide a time duration of a few seconds.

Figure 4:
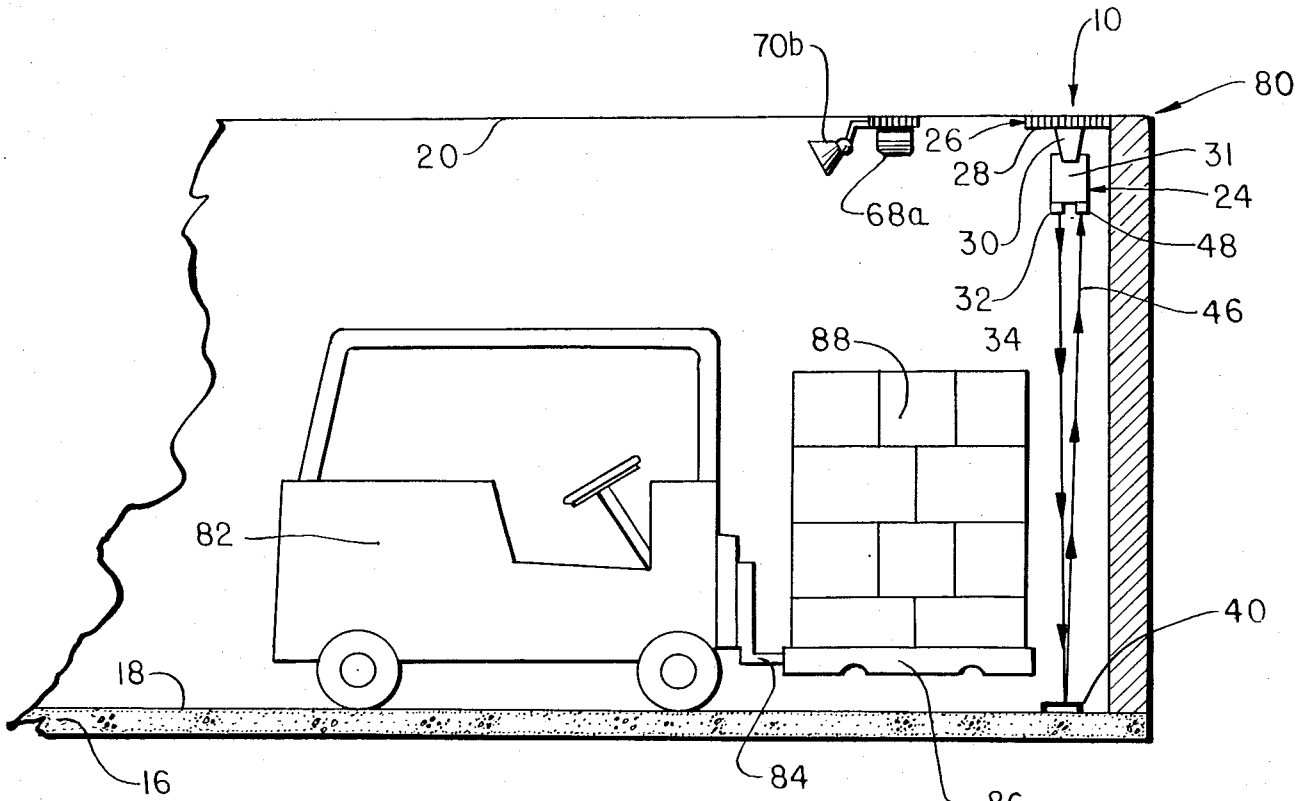
FIG. 4 is a diagrammatic vertical section, showing an installation of the photoelectric indicating device in an industrial environment, for assisting in correctly parking and otherwise positioning an industrial truck, such as the illustrated fork lift truck.

In FIG. 3, the output of the timer 62 is connected to the input of relay means 66, labeled OUTPUT RELAY in FIG. 3. Typically, the relay 66 is of the electromagnetic switching type, having a relay coil to operate switching contacts, adapted to energize one or more output alarm devices, illustrated as a visible alarm 68 and an audible alarm 70. Either or both alarms may be provided. In FIGS. 1 and 2, the visible alarm 68 is in the form of a flashing lamp 68*a*, while the audible alarm 70 is in the form of a buzzer 70*a*. In FIG. 4, the audible alarm is in the form of a horn 70*b*.

The photoelectric control unit 24 includes a power supply 76 for converting alternating current power to direct current power, which is supplied to the amplifier 56, the pulser 58, and the timer 62. The power supply 76 may receive its alternating current power at 115 volts, as labeled in FIG. 3, or some other suitable voltage. The visible alarm 68 and the audible alarm 70 may be energized through the output relay 66 by electrical power at 115 volts alternating current, or some other type of electrical power. I desired, the output relay 66 may be a solid state electronic control device, rather than an electromagnetic switching relay.

The operation of the photoelectric positioning device 10 is illustrated in FIGS. 1 and 2. The photoelectric control unit 24 and the retroreflective mirror 40 are positioned and adjusted so that the incident light beam 34, projected by the light emitting device 32, is reflected by the retroreflective mirror 40, back to the light receiving means 48 on the photoelectric control unit 24. In this specific embodiment, the incident light beam 34 and the reflected light beam 46 are along generally vertical paths and are located at a predetermined position, spaced by the desired interval from the wall or other obstacle 22.

When the vehicle 14 is to be parked, it is driven at a slow speed along the supporting surface 18, until the bumper or some other end portion of the vehicle 14 interrupts the light beam 34 or 46. The photoelectric control unit 24 then causes the energization of the visible alarm lamp 68*a* and the audible buzzer 70*a*, for a single brief interval, typically having a duration of a few seconds. In response to the alarm signals, the operator of the vehicle 14 stops the vehicle in the desired position, spaced a safe distance from the wall 22, so that the vehicle does not come into contact with the wall. By virtue of the photoelectric positioning device 10, it is easy to park or otherwise position the vehicle 14 with a high degree of precision.

Referring in greater detail to FIG. 3, the LED 36 and the lens 38 produce the incident light beam 34, which is reflected back by the retroreflective mirror 40, to provide the reflected light beam 46. The lens 52 focuses the reflected light upon the phototransducer 50, which produces corresponding electrical signals. The LED is pulsed by the pulser 58, so that the LED produces a train of bright brief pulses of light. The signals from the phototransducer 50 are correspondingly in the form of electrical pulses. The amplifier 56 is gated or strobed by the pulser 58, to respond to the electrical pulses, while being virtually unresponsive to unpulsed ambient signals.

As long as the incident light beam 34 and the reflected light beam 46 are uninterrupted, the phototransducer 50 supplies beam related pulses to the amplifier 56, which produces its output at the light output terminal L, while producing no output at the dark output terminal D. When either light beam 34 or 46 is interrupted, the beam related electrical pulses are no longer supplied to the amplifier 56, whereupon it switches its output from the light output terminal L to the dark output terminal D. Thus, a beam interruption signal is produced at the dark output terminal D and is transmitted to the timer 62, which produces a one-shot output pulse or signal of preselected duration, depending upon the adjustment of the timing control knob 64. The one-shot output pulse energizes the output relay 66, which in turn energizes the visible alarm 68 and the audible alarm 70. Either or both alarms may be provided. As shown in FIGS. 1 and 2, the visible alarm is in the form of the flashing light 68*a*, while the audible alarm is in the form of the buzzer 70*a*. In response to these alarms, the operator of the vehicle 14 stops the vehicle at the predetermined position, spaced from the wall or other obstacle 22. It is easy for the operator to position the vehicle 14 in the desired position, close to the wall 22, but without bringing the vehicle into contact with the wall.

FIG. 4 illustrates the vehicle position indicating device 10, substantially the same as illustrated in FIGS. 1–3, but installed in an industrial building 80, for assisting an operator in positioning an industrial truck 82, illustrated as a fork lift truck having a forwardly projecting fork 84, adapted to support a pallet 86, which in turn supports a load 88. The same reference characters have been employed in FIG. 4, as in FIGS. 1 and 2, where applicable.

In FIG. 4, the photoelectric control unit 24 and the retroreflective mirror 40 are positioned to provide the incident light beam 34 and the reflected light beam 46, in a predetermined position, close to the wall or other obstacle 22, to assist the operator in maneuvering the fork lift truck 82, so that the pallet 86 and its load 88 will be deposited in the desired position, close to the wall 22, but spaced therefrom, to avoid contact with the wall.

In FIG. 4, the fork lift truck 82 has been driven close to the desired position. The operator completes the positioning of the truck 82 by driving it slowly in a forward direction until the light beam 34 or 46 is interrupted by the pallet 86 or the load 88. In response to the interruption of the light beam 34 or 46, the photoelectric control unit energizes the flashing lamp 68*a*, serving as the visible alarm 68, and the audible horn 70*b*, serving as the audible alarm 70. The operator will then stop the truck 82 and will lower the fork 84 so as to deposit the pallet 86, with its load 88, in the desired, predetermined position. The timer 62, due to its one-shot operation, automatically de-energizes the alarm devices 68*a* and 70*b*, after a brief interval of energization.

It is easy for the operator to maneuver the fork lift truck 82, so as to position the pallet 86 and the load 88 in the desired predetermined position, without causing the pallet or the load to come into contact with the wall 22 or other obstacle.

In producing the above-described embodiments of the present invention, it is possible to provide certain components in the form of commercially available electronic components. The photoelectric control unit 24 may be provided in the form of a Warner Photoscanner, Model MCS-165, with a Warner plug-in timer module, Model MCS-830, 830-1 or 830-2, affording the timer 64. The Warner components are commercially available from Warner Electric Brake & Clutch Company, Motion Control Systems Division, 1300 North State Street, Marengo, Ill. 60152. The Warner plug-in timer module has programming switches which are used to program the timer module for one-shot operation.

In the embodiments described above, there is a definite advantage in providing mounting means for mounting the photoelectric control means 24 on the overhead structure 20, or some other similar overhead structure, with the light beam 34 directed along a beam path which is generally vertical and generally downward. This advantageous construction reduces the possibility of extraneous interruption or interception of the light beam by the movement of persons, pet animals, or things other than the vehicle. However, the present invention contemplates broadly that the predetermined direction of the light beam may be in any desired or suitable direction, which may be horizontal, vertical or at any intermediate angle. The beam may be directed downwardly, upwardly, horizontally, or at any desired or suitable inclined angle.

For example, the positions of the photoelectric control unit 24 and the reflective device 40 may be interchanged, so that the light beam 34 is initially directed upwardly, and then is reflected downwardly by the reflective device 40, whereby the reflected beam 46 is directed upon the light receiving means 48 of the photoelectric control unit 24. In another construction, the photoelectric control unit 24 and the reflective device 40 are mounted onto opposite vertical walls or other structures, on opposite sides of the parking space for the vehicle. In this construction, the light beam 34 is initially directed horizontally from the photoelectric control unit 24 to the reflective device 40, and then is reflected back horizontally in the opposite direction to the light receiving means 48 of the photoelectric control unit 24. The initial light beam 34 and the reflected light beam 46 establish a boundary for the parking space in which the vehicle is to be positioned.

Figure 5:
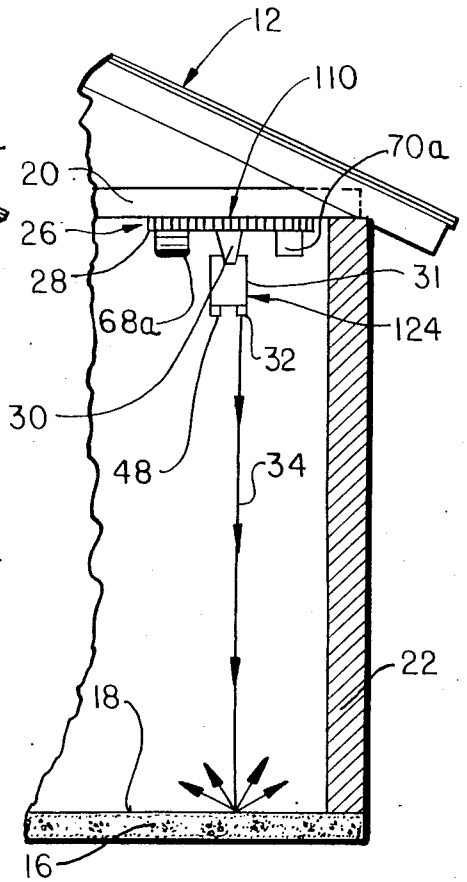
FIG. 5 is a diagrammatic vertical section, similar to FIG. 1, but showing a modified illustrative embodiment which does not employ separate reflective means for reflecting the light beam of the photoelectric device.
Figure 6:
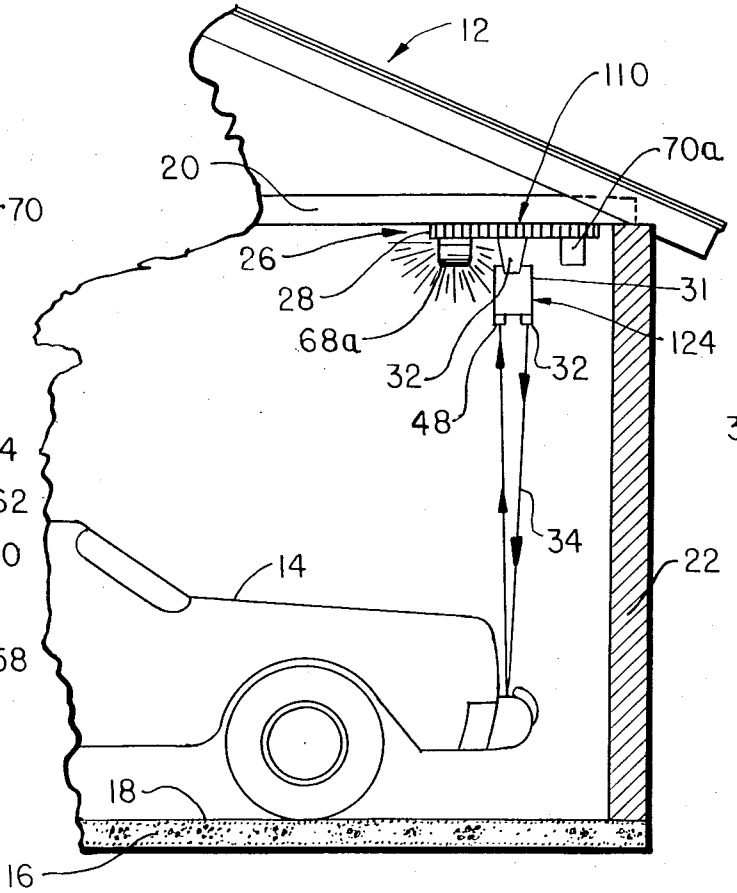
FIG. 6 is a view similar to FIG. 5, but showing the manner in which the vehicle intercepts the light beam and reflects a portion of it back to photoelectric transducer means on the photoelectric device, whereupon the alarm device is energized.
Figure 7:
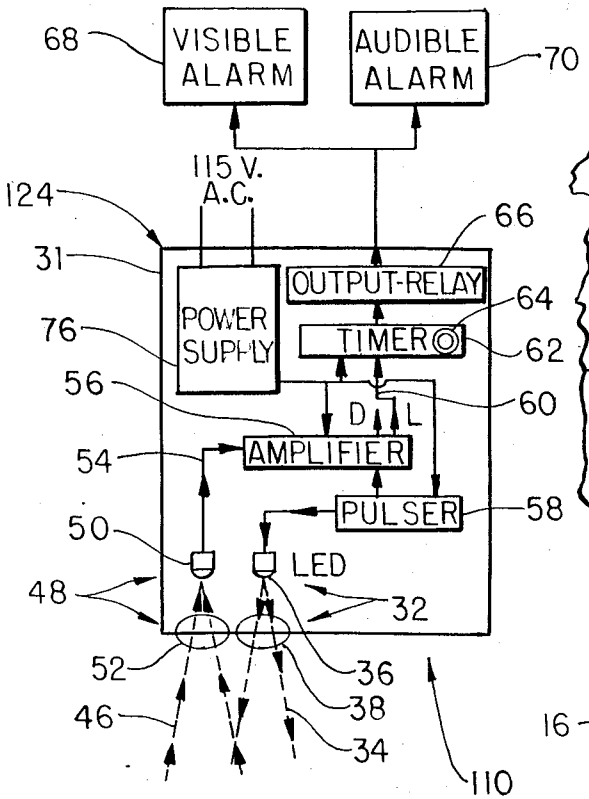
FIG. 7 is a schematic block diagram, illustrating the construction of the photoelectric indicating device of FIGS. 5 and 6.

FIGS. 5–7 illustrate a modified vehicle position indicating device 110, to be described as another illustrative embodiment of the present invention. In most respects, the modified vehicle positioning device 110 is the same as or similar to the device 10 of FIGS. 1–3, described in detail above. In most cases, the same reference characters have been applied in FIGS. 5–7 as in FIGS. 1–3, to indicate that the elements identified by such reference characters are essentially the same as previously described and illustrated. To the extent that the reference characters are the same, the preceding detailed description will not need to be repeated, because it is applicable to the modified vehicle positioning device 110 of FIGS. 5–7. It will be sufficient to describe the differences between the modified embodiment 110 of FIGS. 5–7 and the previous embodiment 10 of FIGS. 1–3.

The vehicle positioning device 110 of FIGS. 5–7 differs from the device 10 of FIGS. 1–3, in that the reflective device or mirror 40 of FIGS. 1–3 is not employed in the device 110 of FIGS. 5–7. Thus, the light emitting device 32 produces a light beam 34, as before, but, in the absence of the vehicle 14, the emitted light beam 34 impinges upon the supporting surface or floor 18 and is scattered and dissipated, so that only an ineffectively small amount of the emitted beam 34 is reflected back to the photoelectric transducer 50 of the beam receiving means 48. The photoelectric transducer 50 does not produce any significant or operative beam-related signal, with the result that the amplifier 56 is not actuated, so that the amplifier 56 does not produce any output signal at the light output terminal L of the amplifier 56, but rather produces an output signal at the dark terminal D.

As shown in FIG. 7, the vehicle positioning device 110 differs from the previously described device 10 in that the output connection 60 is provided or connected between the light output terminal L of the amplifier 56 and the input of the one-shot timing means or device 62. Consequently, the timing device 62 does not produce any output, in the absence of the vehicle 14 in its parking space. Thus, the output relay 66 and the alarm devices 68 and 70 are not energized.

In FIGS. 5–7, the reference character 124 has been applied to the photoelectric control means, because of the changed arrangement of the output connection 60, extending between the light output terminal L of the amplifier 56, rather than the dark output terminal D, as described in connection with the photoelectric control means 24 of FIG. 3.

When the vehicle 14 is maneuvered into its parking space, as shown in FIG. 6, a portion of the vehicle 14 intercepts the emitted light beam 34 and produces a reflected beam 146, enough of which is reflected back to the photoelectric transducer 50 of the beam receiving means 48 to operate the amplifier 56, so that the amplifier 56 produces an output signal at its light terminal L. Such output signal is transmitted by the output connection 60 to the input of the one-shot timer 62, so that the timer produces its timed output signal, whereby the output relay 66 is actuated to energize the visible alarm 68 and the audible alarm 70. In response to the alarms, the operator of the vehicle 14 stops the vehicle at the desired position in its parking space, with the desired clearance between the vehicle and the wall or other obstacle 22. The timer 62 has the effect of shutting off the alarms 68 and 70 after the brief timed interval for which the timer 62 is set.

In the photoelectric control means 124 of FIG. 7, the amplifier 56 is adjusted or designed to have sufficient sensitivity to respond to the relatively weak reflected light beam 146, directed back by the vehicle 14 to the photoelectric transducer of the light receiving means 48.

As shown in FIG. 6, the emitted light beam 34 is reflected by the bumper or some other protruding portion of the vehicle 14, so as to produce the reflected light beam 146, directed back to the photoelectric transducer 50 of the light receiving means 48.

In the vehicle positioning device 110 of FIGS. 5–7, the photoelectric control means 124 is mounted on the overhead support 20, and the light beam 34 is directed downwardly, in a generally vertical direction. This arrangement is highly advantageous, because the light beam 34 is directed in an advantageous manner for interception by the vehicle 14. At the same time, the light beam 34 is directed so as to minimize the possibility of extraneous interception by pedestrians, pet animals and other things moving along the supporting surface 18. Thus, the possibility of extraneous actuation of the alarms 68 and 70 is minimized. However, this invention contemplates broadly that the photoelectric control means may be otherwise positioned, so as to direct the light beam in any desired or suitable direction, which may be horizontal, vertical or at any intermediate angle. The beam may be directed downwardly, upwardly, horizontally, or at any desired or suitable inclined angle. The light beam acts as a boundary or a limit for the space in which the vehicle is to be positioned. When the vehicle reaches such boundary or limit, the beam is intercepted or interrupted, so that the alarm or alarms are actuated for a timed interval. In response to the alarms, the driver stops the vehicle in the desired position or space, as limited by the light beam.

We claim:

1. A vehicle position indicating device for assisting in parking and otherwise positioning a vehicle in a predetermined space on a supporting surface having an overhead structure spaced upwardly from said supporting surface and affording clearance for the vehicle, said device comprising photoelectric control means having overhead mounting means for mounting said photoelectric control means on the overhead structure, said photoelectric control means including light emitting means and means positioning said last-mentioned means for emitting and directing a beam of identifiable light in a generally downward direction toward the supporting surface and along a beam forming a boundary of said space, said photoelectric control means comprising photoelectric transducer means and means directing said last-mentioned means in a generally downward direction for receiving upwardly reflected identifiable light constituting a reflection of said beam and for producing reflection related electrical signals corresponding to said reflected identifiable light, said reflected identifiable light constituting at least a partial continuation of said beam, the vehicle being movable along said supporting surface for intercepting the beam and thereby causing a change in said reflected identifiable light reaching said transducer means whereby said transducer means produces a corresponding change in the refection related electrical signals, amplifier means for receiving said reflection related electrical signals and producing an output signal in response to said change in the reflection related electrical signals, one-shot timing means for receiving each output signal and producing a corresponding one-shot energization signal having a predetermined time duration, alarm means for producing a sensory alarm, and relay means for receiving each one-shot energization signal and correspondingly energizing the alarm means for a time interval corresponding to the time duration of the one-shot energization signal.

2. A vehicle position indicating device according to claim 1, including reflective means adapted to be supported adjacent said supporting surface for receiving the beam and reflecting said beam in a generally upward direction to produce said reflection containing a large quantity of said reflection identifiable light directed upon said photoelectric transducer means, the movement of the vehicle being effective to cause interruption of said reflection by the vehicle whereby the change in the reflected identifiable light constitutes a substantial decrease therein, the corresponding change in the reflection related electrical signals produced by the photoelectric transducer means being a corresponding decrease in said reflection related electrical signals, the amplifier means having means for producing said output signal in response to said decrease in the reflection related electrical signals whereby the alarm means is operative to produce the sensory alarm for said time interval.

3. A vehicle position indicating device according to claim 2, in which said reflective means comprises a retroreflective mirror.

4. A vehicle position indicating device according to claim 1, in which the movement of the vehicle along said supporting surface in effective to cause the vehicle to intercept and reflect the beam of identifiable light back to the photoelectric transducer means whereby the change in the reflected identifiable light constitutes a substantial increase therein, the corresponding change in the reflection related electrical signals produced by the photoelectric transducer means being a corresponding increase in said reflection related electrical signals, the amplifier means having means for producing said output signal in response to said increase in the reflection related electrical signals whereby the alarm means is operative to produce the sensory alarm for said time interval.

5. A vehicle position indicating device for assisting in parking and otherwise positioning a vehicle in a predetermined position relative to a supporting surface having an overhead structure spaced upwardly from said supporting surface and affording clearance for the vehicle, said device comprising photoelectric control means having overhead mounting means for mounting said photoelectric control means on the overhead structure, said photoelectric control means including a light emitting device and means positioning said device for emitting and directing a light beam in a generally downward direction toward the supporting surface, a reflected device adapted to be supported adjacent said supporting surface for receiving the light beam and reflecting said beam in a generally upward direction to provide a reflected light beam, said photoelectric control means comprising a photoelectric transducer and means positioning said transducer for receiving the reflected light beam and producing corresponding beam related electrical signals, amplifier means for receiving said beam related electrical signals and producing a beam interruption output signal in response to each interruption of the light beam by a vehicle, one-shot timing means for receiving each beam interruption signal and producing a corresponding one-shot energization signal, an alarm device operable to produce a sensory alarm, and relay means for receiving each one-shot energization signal and for correspondingly energizing the alarm device for a time interval corresponding to the time duration of the one-shot energization signal.

6. A device according to claim 5, in which said light emitting device comprises a light emitting diode.

7. A device according to claim 5, in which said reflective device comprises a retroreflective mirror.

8. A device according to claim 5, in which said photoelectric transducer comprises a photosensitive transistor.

9. A device according to claim 5, said photoelectric control means comprising pulsing means for pulsing said light emitting device and for corresponding pulsing said amplifier means.

10. A device according to claim 5, said relay means including an electromagnetic switching relay connected between said one-shot timing means and said alarm device.

11. A vehicle position indicating device for assisting in parking and otherwise positioning a vehicle in a predetermined position along a path relative to a supporting surface having an overhead structure spaced upwardly from said supporting surface and affording clearance for the vehicle, said device comprising photoelectric control means and overhead mounting means mounting said control means on the overhead structure, said photoelectric control means including a light emitting device and means positioning said device for emitting and directing a light beam in a generally downward direction toward the supporting surface along a beam path intersecting with the path of the vehicle at the predetermined position, a retroreflective device supported adjacent said supporting surface for receiving the light beam and reflecting said beam in a generally upward direction to provide a reflected light beam, said photoelectric control means comprising a photoelectric transducer and means positioning said transducer for receiving the reflected light beam and producing corresponding beam related electrical signals, amplifier means for receiving said beam related electrical signals and producing a beam interruption output signal in response to each interruption of the light beam by a vehicle, one-shot timing means for receiving each beam interruption signal and producing a corresponding one-shot energization signal, an alarm device operable to produce a sensory alarm, and relay means for receiving each one-shot energization signal and for correspondingly energizing the alarm device for a time interval corresponding to the time duration of the one-shot energization signal.

* * * * *

UNITED STATES PATENT AND TRADEMARK OFFICE

CERTIFICATE OF CORRECTION

PATENT NO. : 4,808,997

DATED : February 28, 1989

INVENTOR(S) : George J. Barkley

It is certified that error appears in the above-indentified patent and that said Letters Patent is hereby corrected as shown below:

On the title page, under item [19], delete "et al." and item [76], Roberta Barkley is deleted as an inventor.

In Col. 11, line 31, claim 1, "refection" is corrected to read --reflection--.

In Col. 11, line 53, claim 2, "reflection" is corrected to read --reflected--.

In Col. 12, line 8, claim 4, "in" is corrected to read --is--.

In Col. 12, line 38, claim 5, "reflected" is corrected to read --reflective--.

In Col. 13, line 1, claim 9, "corresponding" is corrected to read --correspondingly--.

Signed and Sealed this

Twelfth Day of July, 1994

*Attest:*

*Attesting Officer*

Bruce Lehman

BRUCE LEHMAN

*Commissioner of Patents and Trademarks*